United States Patent [19]

Neale

[11] Patent Number: 4,581,277

[45] Date of Patent: Apr. 8, 1986

[54] CHRISTMAS TREE STAND SKIRT

[76] Inventor: Robert W. Neale, 1706 NE. 114th Ave., Portland, Oreg. 97220

[21] Appl. No.: 714,642

[22] Filed: Mar. 25, 1985

[51] Int. Cl.[4] ..... A41D 1/14

[52] U.S. Cl. ..... 428/181; 2/211; 150/52 R; D11/130

[58] Field of Search ..... D11/130; 47/21, 23, 47/40.5; 428/100, 7, 181; 150/52 R; 2/211

[56] References Cited

U.S. PATENT DOCUMENTS

| | | | |
|---|---|---|---|
| 104,418 | 6/1870 | Brunson | 47/23 |
| D. 188,192 | 6/1960 | Riveras | D11/130 |
| D. 229,758 | 1/1974 | Bartel | D11/130 |
| D. 280,979 | 10/1985 | Groth | D11/130 |
| 1,446,416 | 2/1923 | Curtiss | 47/21 |
| 2,164,966 | 7/1939 | Tutein | 428/181 X |
| 2,424,114 | 7/1947 | Polakoff | 2/211 |
| 2,550,121 | 4/1951 | Medd | 2/211 |
| 2,555,564 | 6/1951 | Berman | 428/181 |
| 2,619,646 | 12/1952 | Torricelli | 428/181 X |
| 2,748,516 | 6/1956 | McClusky | D11/130 X |
| 2,781,811 | 2/1957 | Dilar et al. | 150/52 R |
| 2,826,239 | 3/1958 | Villoresi | 428/181 |
| 2,850,842 | 9/1958 | Eubank, Jr. | 150/52 R X |
| 2,868,255 | 1/1959 | Fancher | D11/118 X |
| 2,911,025 | 11/1959 | Paros | D11/130 X |
| 3,295,577 | 1/1967 | Danielson | 428/100 X |
| 3,408,661 | 11/1968 | Hammond | 428/40 X |
| 3,750,731 | 8/1973 | Brimmell | 428/181 X |

*Primary Examiner*—Henry F. Epstein
*Attorney, Agent, or Firm*—Olson and Olson

[57] ABSTRACT

A decorative Christmas tree stand skirt comprises an elongated sheet of material which is folded into a plurality of transverse uniform pleats throughout its length. Registering holes are provided through the pleats adjacent one side edge of the material and a tie cord is inserted freely therethrough for adjustably securing the one side edge of the pleated material about the upper ring of a Christmas tree stand. A conventional two component Velcro type fastener is attached to the opposite longitudinal end edges of the material, one component on one edge of the material and the other component on the other edge of the material, for releasably fastening the opposite edges together, whereby the skirt completely encircles and hides the Christmas tree stand. The Velcro fastener may be released in order to separate the meeting radial edges of the skirt for permitting access to the tree stand water reservoir for refilling without necessitating removal of the encircling decorative skirt from the stand.

4 Claims, 5 Drawing Figures

CHRISTMAS TREE STAND SKIRT

BACKGROUND OF THE INVENTION

This invention relates to covers for christmas tree stands, and more particularly to a convenient and decorative pleated tree stand skirt which is arranged to surround and be attached to a christmas tree stand to hide the latter after the tree and stand has been set up and adjusted, and to permit easy access to the stand for watering.

Tree stand covers are known in the art and generally involve special blankets which are arranged to be tied about the trunk of a tree and draped over the stand, extending outwardly therefrom on the floor beneath the tree in order to catch falling needles. Illustrative of such art are U.S. Pat. Nos. 2,748,516; 2,868,255; 2,911,025; and U.S. Pat. Nos. Des. 229,758; and 188,192. However, these devices are costly to manufacture, are difficult to arrange into operative position about a tree and stand, are bulky and cumbersome to fold into small packages for storage, and are not adjustable to fit various diameter stands. Another device which bears some relevance to the present invention is disclosed in U.S. Pat. No. 104,418 in which a tree trunk protector comprises a conical member arranged to be wrapped snugly around the base trunk of the young tree and secured thereabout by springs. The member is formed of water repelling tar paper material or the like, and the base of the member is buried in the earth for the purpose of preventing destructive but non-burrowing insects from gaining access to the base of the tree and its root structure.

SUMMARY OF THE INVENTION

In its basic concept, this invention provides a pleated christmas tree stand skirt which is configured to be unfolded from a collapsed, storage position by fanning the skirt circularly about a tree stand and connecting the meeting radial edges of the skirt together, forming a conical, decorative cover which hides the tree stand.

It is by virtue of the foregoing basic concept that the principal objective of this invention is achieved; namely, the provision of a christmas tree stand skirt which overcomes the limitations and disadvantages of the prior art.

Another object of this invention is the provision of a pleated christmas tree stand skirt which permits easy access to the water reservoir of the tree stand for varifying and replenishing the water supply required by a christmas tree.

Another object of this invention is the provision of a christmas tree stand skirt of the class described which accommodates attachment to a wide variety of different sized and shaped conventional tree stands.

Another object of this invention is the provision of a christmas tree stand skirt of the class described which is extremely easy to set up and disassemble, and also folds easily into a convenient and efficient collapsed position for storage and packaging.

Further object of this invention is the provision of a christmas tree stand skirt of the class described which is decorative and enhances the appearance of a decorated christmas tree on display.

A still further object of this invention is the provision of a christmas tree stand skirt of the class described which is of simplified construction for economical manufacture.

The foregoing and other objects and advantages of this invention will appear from the following detailed description, taken in connection with the accompanying drawings of a preferred embodiment.

DESCRIPTION OF THE PREFERRED EMBODIMENT

Figure 1:
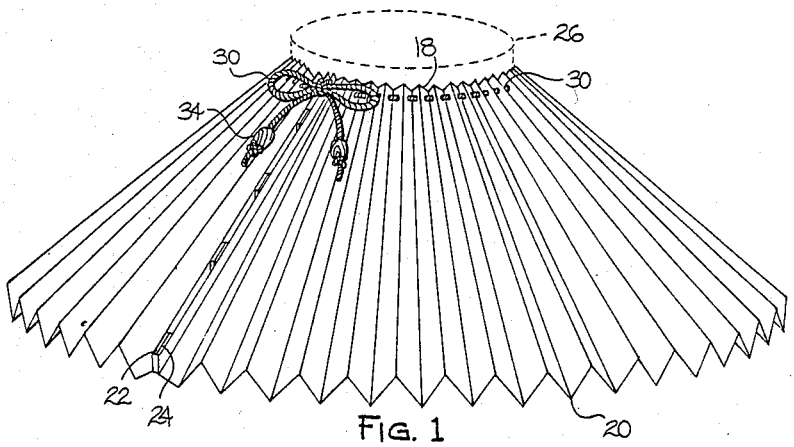
FIG. 1 is a perspective view of a pleated christmas tree stand skirt embodying the features of this invention, the skirt shown in position about a christmas tree stand, the visible parts of which are shown in broken lines.

A christmas tree stand skirt 10 comprises an elongated rectangular sheet of material such as paper or fabric which is folded, preferably uniformly, into a plurality of transverse pleats 12 throughout its length. The pleated sheet of material has longitudinal ends 14 and 16 and side edges referred to hereinafter as inner side edge 18 and outer side edge 20. The pleating of the material results in the sheet assuming an "accordion" characteristic, whereby its length is adjustable according to the degree that the pleats are unfolded. Thus, the sheet of material may assume a collapsed position in which the pleats are snugly folded, as in FIG. 2 of the drawings On the other hand, the sheet may be fanned circularly, by increasing the included angle of the pleats at their outer side edges 20 to a greater extend than at their inner side edges 18, to form a circular skirt with a central opening of desired diameter.

Means is provided to releasably connect the opposite, longitudinal ends 14 and 16 of the fanned pleated sheet of material together. The connecting means illustrated is a conventional two component Velcro type fastener. One component, for example the loop member 22, is attached by sewing, gluing or the like to one longitudinal end 14 or 16 and the other component, the hook member 24 is attached to the opposite longitudinal edge. Accordingly, when the material is fanned circularly and the opposite ends 14 and 16 of the elongated sheet of material are brought together, the resulting meeting radial edges 14 and 16 are secured releasably together by engagement of the cooperating registering Velcro fastener components 22 and 24.

Figure 3:
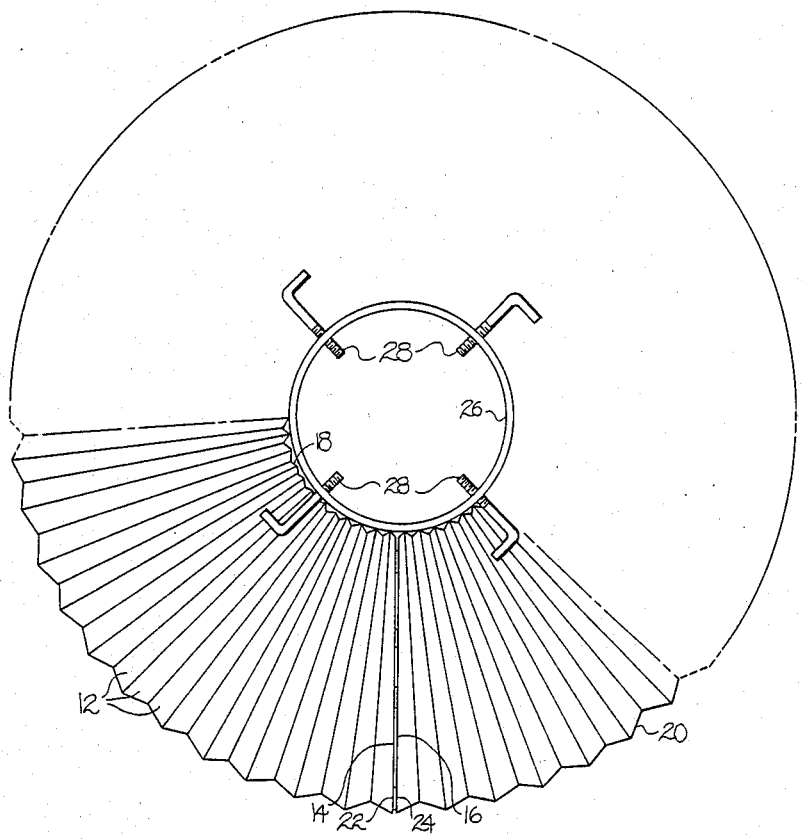
FIG. 3 is a plan view of the skirt of FIG. 1 installed about a conventional tree stand, the meeting radial edges of the skirt secured together with Velcro fasteners.
Figure 5:
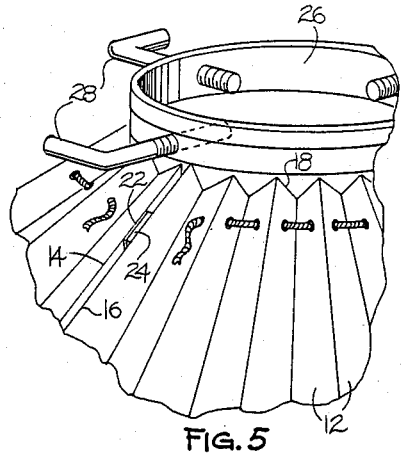
FIG. 5 is a fragmentary perspective view of the inner portion of the skirt encircling a tree stand, the fasteners holding the skirt in closed position thereon.

FIGS. 1, 3 and 5 of the drawings show the christmas tree stand skirt of this invention positioned about a convenional christmas tree stand having an upper ring 26 mounting adjustable tree securing adjustment thumb screws 28. In use, the skirt is fanned circularly about the ring 26, the inner side edge 18 of the skirt encircling the ring completely. The meeting radial edges 14 and 16 of the skirt are brought together and secured to one another by engagement of the cooperating components of the Velcro fastener.

As is best illustrated in FIGS. 1 and 3, by virtue of the pleated construction of the material, the inner edge 18 of the skirt is able to encircle the small tree ring 26 while the outer edge 20 forms an enlarged circle completely surrounding and hiding the water bowl and the legs (not shown) of the christmas tree stand. This result is a direct consequence of the pleating, which permits the folds 12 at the inner, tree ring encircling edge 18 to be closer and tighter than are the corresponding folds at the outer, floor supported edge 20 of the skirt. This change in the included angle of each pleat, smaller at the inner edge of the skirt and larger at the outer edge of the skirt, also results in the skirt being naturally urged into the conical configuration shown in FIGS. 1 and 5. This assists the user is arranging the skirt during initial setup. It also tends to minimize the possiblity of the skirt inadvertently dislodging from its engagement encircling the tree stand.

Figure 4:
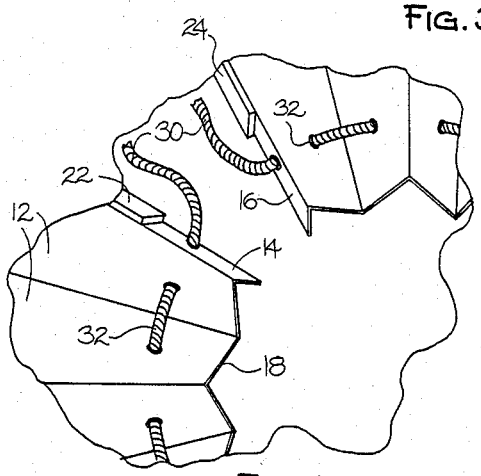
FIG. 4 is a fragmentary plan view of the inner opening portion of the pleated skirt of the invention in partially opened consition, showing the arrangement of a tie cord encircling the inner opening and the cooperating components of a Velcro fastener associated with the meeting radial edges of the skirt.

The christmas tree stand skirt of this invention also preferably includes securing means by which the inner edge 18 of the skirt may be snugly attached about christmas tree stand rings having various diameters, in order that a single skirt may accommodate a variety of different sized conventional stands. The securing means illustrated herein comprises a length of tie cord 30 which extends freely through holes 32 provided through the pleats 12 adjacent the inner end edge 18 of the skirt, as viewed in FIGS. 1 and 4. The opposite terminal ends of the cord 30 extend from the meeting radial 14 and 16 of the skirt so that when the cord ends are drawn and tied together, the radial edges 14 and 16 at the inner end of the skirt are drawn together snugly, and the inner end of the skirt is cinched rather snugly about the christmas tree stand upper ring 26.

The tie cord itself may be of ordinary flexible twine or string, decorative material or cord having elastic properties which will ensure a continuously snug fit, as may be desired. The terminal ends of the cord may, as illustrated, include enlarged portions, such as beads 34 arranged to prevent the ends of the cord from inadvertently passing through the holes and becoming disengaged from the skirt, requiring their being rethreaded through the holes.

Figure 2:
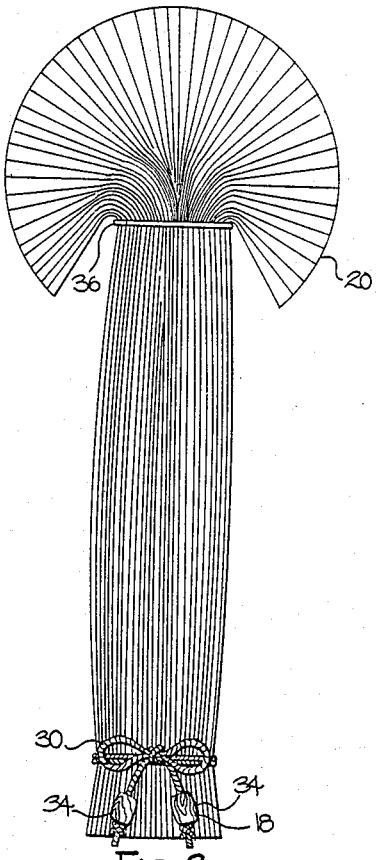
FIG. 2 is a plan view of the skirt of FIG. 1 shown in collapsed, storage condition.

When not in use, the skirt may be folded, by collapsing the pleats into the fully retracted, folded position of FIG. 2 for storage. The tie cord is wrapped about the inner end of the skirt, as shown, to hold the skirt against unfolding, and the outer end 20 may be secured in position by a simple rubber band 36.

From the folded, storage position of FIG. 2, the assembly and use of the christmas tree stand skirt of this invention is as follows: First, the skirt is removed from its shipping and storage wrapper, if provided, and the rubber band 36 is removed to release the outer end 20. The tie cord 30 is untied and unwrapped from about the material. The skirt, no longer restrained in folded condition, is now free to be fanned circularly by spreading the accordion pleats.

The skirt is positioned so that its inner edge 18 abuts a christmas tree stand ring, the tree having been already positioned thereon and adjusted as desired for display. The outer edge 20 of the skirt slopes downwardly from the inner edge 18 at an angle which places the outer edge on a floor outside the perimeter of the christmas tree stand legs (not shown). The skirt is then fanned circularly about the base of the stand, the inner edge 18 of the skirt being drawn about the circumference of the elevated stand ring 26 while the outer edge of the skirt is disposed on the floor encircling the leg structure of the stand. The tie cord 30 is drawn at both of its ends to tighten the inner edge 18 of the skirt snugly about the stand ring, whereupon the cord is tied to keep the skirt in position.

Finally, the meeting radial edges 14 and 16 of the skirt are drawn together so that the aligned, corresponding fastener components 22 and 24 attached thereto are brought together, securing the radial edges together and holding the skirt in the operative condition shown in FIG. 1. The skirt may then be adjusted to even the pleats and position the outer edge of the skirt properly on the floor about the stand, as may be desired.

The resulting skirt thus formed is conical in configuration and, by virtue of the pleated construction, has no sags or unsightly folds. The unsightly conventional christmas tree stand is entirely hidden from view. Use of the christmas tree stand skirt of this invention, in addition to enhancing the appearance of the christmas tree, also prevents packages from inadvertently making contact with the water reservoir of the christmas tree stand. It also prevents the inadvertent and dangerous contact of dangling tree lights with the water reservoir.

When so positioned about a tree stand, and secured thereon by the tie cord 30, the radial edges 14 and 16 may be separated and rejoined without disrupting the skirt's proper positioning and attachment on the stand. In this manner, the skirt may be opened to expose the water reservoir of the stand to check on and replenish water supply to the tree without necessitating removal of the skirt each time watering is needed.

Removal of the skirt follows the reverse procedure, followed by collapsing the skirt into completely folded condition, wrapping the tie cord about the folded skirt and reapplying the rubber band 36 to hold the outer end of the skirt for storage until the next season's use.

The skirt material may, as discussed earlier, be of paper, plastic or fabric sheet material, but preferably of a weight that will allow the skirt to assume the position of FIG. 1 without sagging or otherwise losing its structural integrity. Also, the material may include ornamental designs and decorations befitting the season to further enhance the appearance of the skirt in use. Further, the inner and outer edges may also include additional decorative material, such as fabric, ribbon, lace, or other desirable material in order to further enhance the appearance of the skirt and also to prevent tearing and fraying which may result from repeated use.

From the foregoing it will be apparent to those skilled in the art that various changes, other than those previously described, may be made in the size, shape, type, number and arrangement of parts described hereinbefore. For example, the illustrated Velcro fasteners 22, 24 may be replaced with snap fasteners or any other suitable type of conventional fastener. The securing tie cord 30 may be replaced with an elastic securing cord attached at its ends to the ends 14, 16 for automatic adjustment of the central opening to the size of the tree stand ring when the fastener is closed. These and other changes may be made, as desired, without departing from the spirit of this invention and the scope of the appended claims.

Having thus described my invention and the manner in which it may be used,

I claim:

1. A decorative christmas tree stand skirt comprising:

(a) an elongated sheet of material folded into a plurality of transverse pleats extending throughout the entire length and width of the sheet. and (b) fastener means on the opposite longitudinal ends of the elongated sheet of material arranged to secure said opposite longitudinal ends releasably together when the pleated sheet is fanned to circular shape.

2. The christmas tree stand skirt of claim 1 wherein said fastener means comprises a conventional two component Velcro type fastener, the loop component disposed on one longitudinal end of the elongated sheet of material and the hook component on the other longitudinal end thereof, the components arranged to register with and engage each other when the longitudinal ends are brought together.

3. The christmas tree stand skirt of claim 1 including a hole through each pleat adjacent one common side edge of the material and an elongated securing cord received freely through said holes in the pleats, the cord being arranged to draw the adjacent pleats together adjustably to fit closely about the upper portion of a christmas tree stand.

4. The christmas tree stand skirt of claim 3 wherein the securing cord is an elongated flexible tie cord the opposite ends of which extend outward through the holes in the pleats at the opposite longitudinal ends of the sheet.

* * * * *